US009203164B2

(12) United States Patent
Lo Hine Tong et al.

(10) Patent No.: US 9,203,164 B2
(45) Date of Patent: Dec. 1, 2015

(54) ISOLATION OF ANTENNAS MOUNTED ON A PRINTED CIRCUIT BOARD

(71) Applicant: Thomson Licensing, Issy de Moulineaux (FR)

(72) Inventors: Dominique Lo Hine Tong, Cesson Sevigne (FR); Philippe Minard, Cesson Sevigne (FR); Jean-Luc Robert, Cesson Sevigne (FR)

(73) Assignee: Thomson Licensing, Issy-les-Moulieaux (FR)

( * ) Notice: Subject to any disclaimer, the term of this patent is extended or adjusted under 35 U.S.C. 154(b) by 13 days.

(21) Appl. No.: 13/744,495

(22) Filed: Jan. 18, 2013

(65) Prior Publication Data

US 2013/0187823 A1 Jul. 25, 2013

(30) Foreign Application Priority Data

Jan. 20, 2012 (FR) ..... 12 50571

(51) Int. Cl.
*H01Q 21/28* (2006.01)
*H01Q 1/52* (2006.01)
*H01Q 1/22* (2006.01)

(52) U.S. Cl.
CPC ..... *H01Q 21/28* (2013.01); *H01Q 1/22* (2013.01); *H01Q 1/521* (2013.01); *H01Q 1/526* (2013.01)

(58) Field of Classification Search
CPC ..... H01Q 21/28; H01Q 1/526; H01Q 1/521
USPC ..... 343/841
See application file for complete search history.

(56) References Cited

U.S. PATENT DOCUMENTS

| | | | | |
|---|---|---|---|---|
| 2003/0193437 | A1 | 10/2003 | Kangasvieri et al. | |
| 2004/0137971 | A1* | 7/2004 | Shoji | 455/575.5 |
| 2006/0284778 | A1 | 12/2006 | Sanford et al. | |
| 2008/0143623 | A1 | 6/2008 | Pintos et al. | |
| 2008/0158079 | A1 | 7/2008 | Lin et al. | |
| 2010/0238072 | A1* | 9/2010 | Ayatollahi et al. | 343/700 MS |

FOREIGN PATENT DOCUMENTS

| | | |
|---|---|---|
| CN | 201845871 | 5/2011 |
| EP | 1418642 | 5/2004 |
| EP | 1950834 | 7/2008 |
| FR | 2910182 | 6/2008 |
| JP | 2005244317 | 9/2005 |
| JP | 2006121630 | 5/2006 |

* cited by examiner

*Primary Examiner* — Hoang V Nguyen
*Assistant Examiner* — Michael Bouizza
(74) *Attorney, Agent, or Firm* — Robert D. Shedd; Brian J. Cromarty

(57) ABSTRACT

The present invention relates to a circuit comprising on a same board at least one antenna, a processing circuit and a cover covering the processing circuit. Said circuit comprises between the antenna and the cover at least one isolation element realized partly on the board and partly on the cover.

5 Claims, 1 Drawing Sheet

ISOLATION OF ANTENNAS MOUNTED ON A PRINTED CIRCUIT BOARD

This application claims the benefit, under 35 U.S.C. §119 of FR patent application Ser. No. 1250571, filed 20 Jan. 2012.

TECHNICAL FIELD

The present invention relates, in a general manner, to the printed circuit boards used in wireless systems. It relates more particularly to boards comprising on a same substrate at least one antenna and a processing circuit covered by a cover such as a shielding cover.

TECHNOLOGICAL BACKGROUND

In the wireless communications field, increasing use is made of MIMO (Multiple Input Multiple Output) circuits in order to increase the capacity of the transmission circuits and improve the coverage. The result is a use of a larger number of antennas. When the antennas are printed directly or placed on the printed circuit board or PCB, this induces, in the ground plane, currents that potentially affect the behaviour of the other antennas as well as that of the processing circuits positioned near the antennas. It is therefore necessary to isolate the elements from each other to limit current leakage without deteriorating the performances of the antennas. Moreover, in the case of MIMO systems, the antennas must be strongly isolated to obtain the level of decorrelation from the required signal to provide the optimum performances for the MIMO system. However, the space on the board being limited, the isolation constraints are very strong. In addition, in the case of systems operating at several frequency bands, an isolation between bands is most frequently required to ensure a correct coexistence of all the radios in the frequency band.

Moreover, shielding covers are frequently used fixed on the top of the processing circuit to reduce the electromagnetic interferences and radio frequencies, by reducing the radiation levels. This use is increasingly frequent as the current wireless systems are most often multi-band and multi-mode, which leads to greater interference problems. Moreover, the tendency toward miniaturization of wireless devices and toward the integration of multiple circuits on a same board requires improved isolation and shielding. In addition, the regulation relating to the levels of electromagnetic waves and radio frequencies is increasingly restrictive.

It is known, particularly in U.S. patent 2003/0193437, to use slots between two antennas to reduce the mutual coupling of the antennas and limits surface current leaks. However, this type of isolation requires surface because the length of the slots is noticeably equal to $\lambda/4$ where $\lambda$ is the wavelength at the operating frequency of the circuit. Hence, for an operating frequency of 2.4 GHz, the wavelength is about 30 mm.

SUMMARY OF THE INVENTION

The present invention thus proposes a low cost solution to the above problems that enables the required isolation to be obtained without increasing the size of the printed circuit board and without adding additional components or mechanical parts.

The present invention relates to a circuit comprising on a same board at least one antenna, a processing circuit and a cover covering the processing circuit, characterized in that it comprises, between the antenna and the cover, at least one isolation element formed by a slot line partly realized on the board and partly on the cover.

According to one embodiment, the slot line comprises a first and a second slot line interconnected by a third slot line. The first and a second slot lines have a first length, respectively L1 and L2 on the board and a second length, respectively L'1 and L'2 on the cover such that L1+L'1 is equal to or different from L2+L'2. The length of the first and second slot-line is close to $\lambda g/4$ where $\lambda g$ is the wavelength at the operating frequency.

BRIEF DESCRIPTION OF THE DRAWINGS

Other characteristics and advantages of the invention will appear upon reading the description of an embodiment realized with reference to the enclosed drawing, wherein.

DETAILED DESCRIPTION OF ONE EMBOFDIMENT

The present invention is described by referring to a printed circuit board used in an application comprising two antennas operating in the band of 2.4 GHz with a 2×2 MIMO circuit capable of being integrated into a set-top box. However, it is obvious to those skilled in the art that this embodiment is provided for information only and can be modified in many ways without leaving the scope of the present invention. It can be used in many devices operating in a wireless manner such as mobile devices, tablets, gateways, etc.

Figure 1:
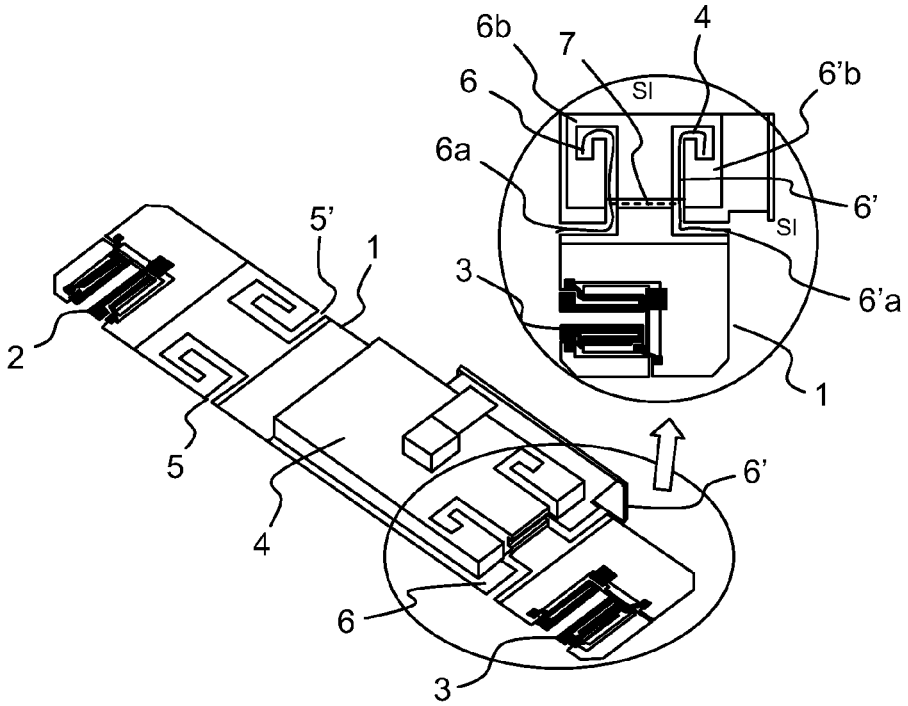
FIG. 1 is a diagrammatic perspective view of an embodiment of the present invention, the circled part being an enlarged view of a portion of the board on which the present invention is realized.

As shown in FIG. 1, on a board 1 two antennas 2 and 3 were realized at each end of the board. Between the two antennas 2 and 3, were mounted on the same board 1 a processing circuit for the signals received and emitted by the two antennas. This processing circuit is covered by a shielding cover 4 to reduce the electromagnetic interferences and the radiofrequency interferences while isolating the processing circuits of the antennas.

In a known manner, the shielding cover 4 is generally made by stamping and fixed to the board during the same assembly procedure as the components, namely by using component surface mount technology. The cover can be realized in a single part or in two parts to enable the inspection and repair of the components.

As shown in FIG. 1, one of the antennas, namely the antenna 2 in the embodiment shown, is isolated from the cover 4 by two isolation slots 5, 5' realized directly on the printed circuit board 1 along the edges of said board. However, as shown in FIG. 1, the second antenna 3 is positioned near the cover 4. So as not to increase the surface of the printed circuit board and, as shown in the enlarged part of FIG. 1, in accordance with the present invention, the isolation element between the antenna 3 and the cover 4 is realized partly on the board 1 and partly on the cover 4. In a more precise manner and as shown on the enlarged part, the isolation means is constituted by two slot-lines 6 and 6' each having two parts, that is 6*a*, 6*b*, 6'*a* and 6'*b*, the part 6*a* and 6'*a* being realized in the printed circuit board 1 whereas the part 6*b* and 6'*b* is realized in the cover 4. To prevent these two slot-lines 6 and 6' from being short circuited at the level of the printed circuit, they are interconnected by a slot 7.

To obtain the required isolation, the total length of each slot 6, 6' is chosen to be noticeably equal to $\lambda g/4$ where $\lambda g$ is the wavelength at the operating frequency. Hence, if the parts 6*a* and 6'*a* have respectively lengths L1 and L2 and if the parts 6*b* and 6'*b* have respectively lengths L'1 and L'2, the total length of the slots 6 and 6' must be such that $L1+L'1 \cong L2+L'2 \cong \lambda g/4$. However, solutions such that $L1+L'1 \neq L2+L'2$ are also within the scope of the invention.

A device such as shown in FIG. 1 was simulated with the 3D electromagnetic simulation tool known under the name HFSS (Ansys). A first simulation was realized without the isolation element in accordance with the present invention and a second simulation was realized with an isolation element such as shown in FIG. 1.

Figure 2:
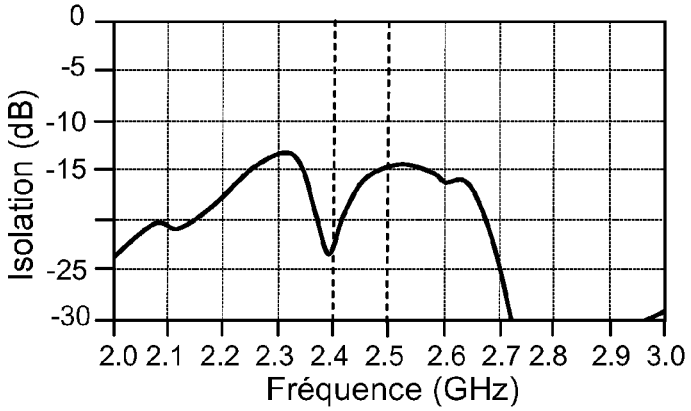
FIG. 2 shows the level of isolation between the two antennas of FIG. 1 without the isolation element in accordance with the present invention.

As shown in FIG. 2, it is seen that without the isolation element in accordance with the present invention, the isolation level in the band of the 2.4 GHz is, in the worst case, around 14 dB.

Figure 3:
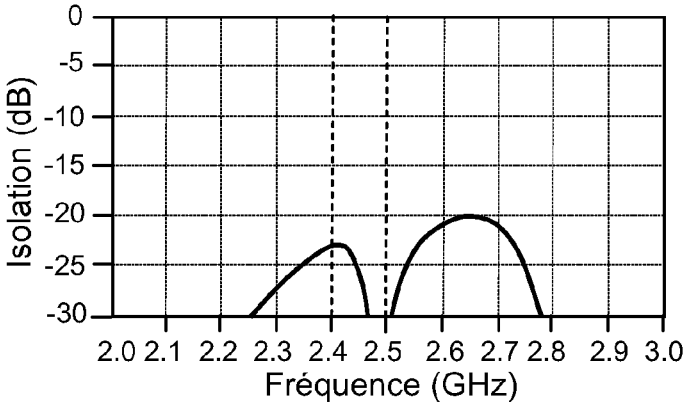
FIG. 3 is a curve representing the level of isolation between the two antennas with the isolation element in accordance with the present invention.

As shown in FIG. 3, the isolation response between the two antennas is now around −20 dB in the band of the 2.4 GHz, which shows an increase of more than 5 dB. The line of the surface currents when the antenna 3 is excited, shows the efficiency of the isolation elements 6 and 6' in relation to the result obtained without these isolation elements. A reduction of the coupling between the two antennas is thus obtained and a behaviour of the antenna 3 less sensitive to its position on the board and to the manner of connecting its ground plane to the overall ground of the system.

It is evident to those skilled in the art that the slot-lines realizing the isolation element can have identical or different lengths in such a manner as to increase either the isolation level or the isolation band. Moreover, the slots can have an L form or a C form or any other form compatible with their location.

What is claimed is:

1. Circuit comprising on a board at least one antenna, a processing circuit and a cover covering the processing circuit, wherein said circuit comprises, between the antenna and the cover, at least one isolation element for isolating the antenna from the cover, the isolation element being formed by at least one slot line partly realized on the board and partly on the cover.

2. Circuit according to claim 1, wherein the at least one slot line comprises a first slot-line and a second slot-line interconnected by a third slot-line.

3. Circuit according to claim 2, wherein the first and the second slot-lines each have a first respective part of a first length on the board and a second respective part of a second length, on the cover such that the sum of the first length and the second length of the first slot line is equal to the sum of the first length and the second length of the second slot line.

4. Circuit according to claim 2, wherein the first and the second slot-lines each have a first respective part of a first length on the board and a second respective part of a second length, on the cover such that the sum of the first length and the second length of the first slot line is different from the sum of the first length and the second length of the second slot line.

5. Circuit according to claim 2, wherein the first and second slot-lines each have a total length close to $\lambda g/4$ where $\lambda g$ is the wavelength at an operating frequency.

* * * * *